United States Patent [19]

Jurkowski

[11] 4,412,466

[45] Nov. 1, 1983

[54] TUBULAR KNIFE

[75] Inventor: Walter J. Jurkowski, Fairfield, Conn.

[73] Assignee: Pitney Bowes Inc., Stamford, Conn.

[21] Appl. No.: 295,195

[22] Filed: Aug. 19, 1981

Related U.S. Application Data

[62] Division of Ser. No. 92,617, Nov. 8, 1979, abandoned.

[51] Int. Cl.[3] ..... B26D 1/38

[52] U.S. Cl. ..... 83/200; 83/199; 83/575

[58] Field of Search ..... 83/199, 575, 200

[56] References Cited

U.S. PATENT DOCUMENTS

| | | | |
|---|---|---|---|
| 2,507,059 | 5/1950 | Suman | 83/199 X |
| 3,149,518 | 9/1964 | Winestock | 83/199 X |
| 3,855,891 | 12/1974 | Young | 83/595 X |
| 4,063,481 | 12/1977 | Raudys et al. | 83/199 |
| 4,116,784 | 9/1978 | Lass | 83/199 X |

*Primary Examiner*—Donald R. Schran

*Attorney, Agent, or Firm*—Lawrence E. Sklar; William D. Soltow, Jr.; Albert W. Scribner

[57] ABSTRACT

A tubular knife comprising a stationary, inner cylindrical member having a slot extending substantially longitudinally thereof, the slot having a longitudinally extending upper edge and a longitudinally extending lower cutting edge, a rotatable, outer tube concentric and substantially contiguous with the inner member, the outer tube having a slot substantially co-extensive with the slot of the inner member, the outer tube slot having an upper cutting edge inclined at a slight angle with respect to the lower cutting edge of the inner member slot, a device for biasing the outer tube to a position wherein the slot of the outer tube is substantially aligned with the slot of the inner member, and means for rotating the upper cutting edge of the outer slot past the lower cutting edge of the inner slot.

3 Claims, 7 Drawing Figures

TUBULAR KNIFE

This is a division of application Ser. No. 092,617, filed Nov. 8, 1979, now abandoned.

BACKGROUND OF THE INVENTION

The instant invention relates to cutting knives, and more particularly to a tubular knife.

It is well known to form cutting devices by moving two opposed cutting edges past each other in scissor-like fashion. However, in industrial applications, such as in electrostatic photocopiers, where a substantial quantity of cutting takes place, it is desirable to have a cutting device which will perform well for an extended period of time with virtually no need for maintenance or adjustment.

SUMMARY OF THE INVENTION

Accordingly, the instant invention provides a tubular knife. The knife comprises a stationary, inner cylindrical member having a slot extending substantially longitudinally thereof, the slot having a longitudinally extending upper edge and a longitudinally extending lower cutting edge, a rotatable, outer tube concentric and substantially contiguous with the inner member, the outer tube having a slot substantially co-extensive with the slot of the inner member, the outer tube slot having an upper cutting edge inclined at a slight angle with respect to the lower cutting edge of the inner member slot, means for biasing the outer tube to a position wherein the slot of the outer tube is substantially aligned with the slot of the inner member, and means for rotating the upper cutting edge of the outer slot past the lower cutting edge of the inner slot.

DETAILED DESCRIPTION

Figure 1:
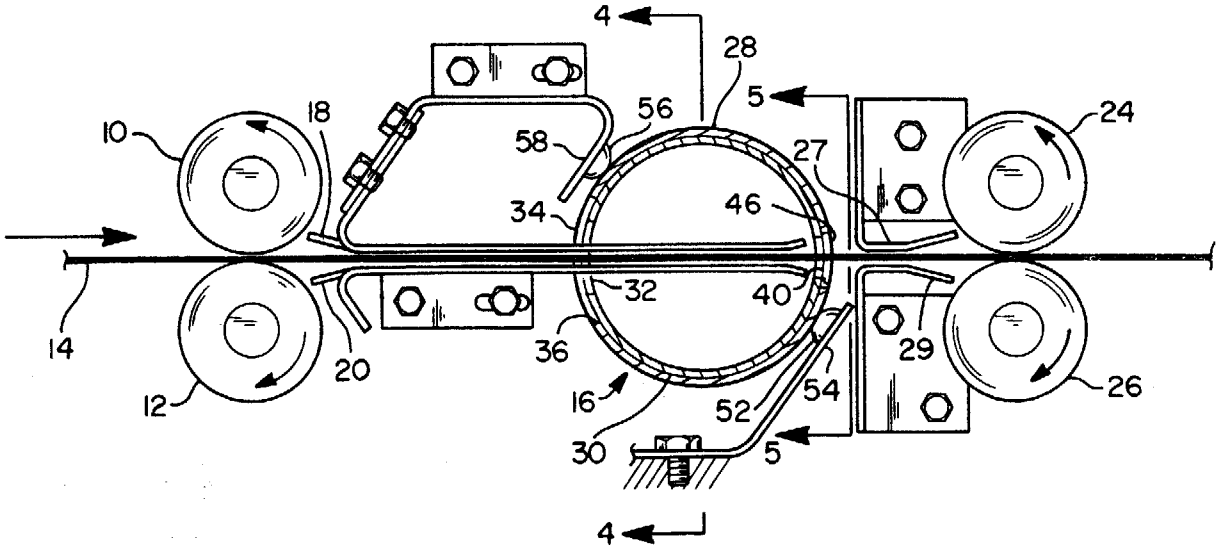
FIG. 1 is a vertical sectional view of a tubular knife according to the instant invention for cutting paper together with other paper handling apparatus.
Figure 2:
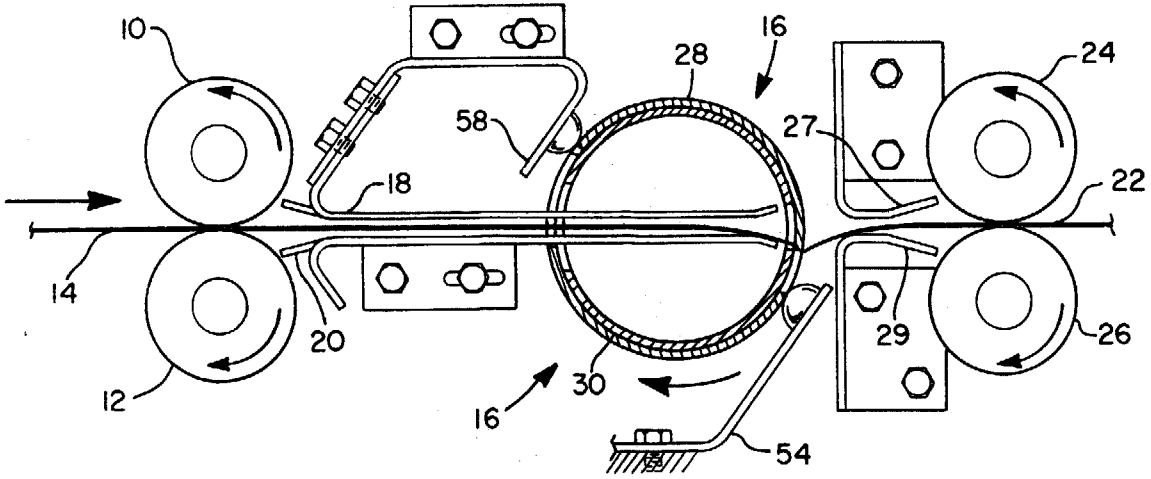
FIG. 2 is similar to FIG. 1 except that is shows the paper immediately after it has been cut.

In describing the preferred embodiment of the instant invention, reference is made to the drawings, wherein there is seen in FIG. 1 a pair of feed rollers 10 and 12 rotatable in the directions indicated for feeding a web of paper 14 to a tubular knife generally designated 16 through upper and lower paper guides 18 and 20 respectively which extend into the knife 16. Once the paper web 14 is cut by the knife 16, the severed portion 22 (see FIG. 2) is pulled away from the knife 16 by a second pair of feed rollers 24 and 26 rotatable in the directions indicated between a second pair of paper guides 27 and 29.

Figure 4:
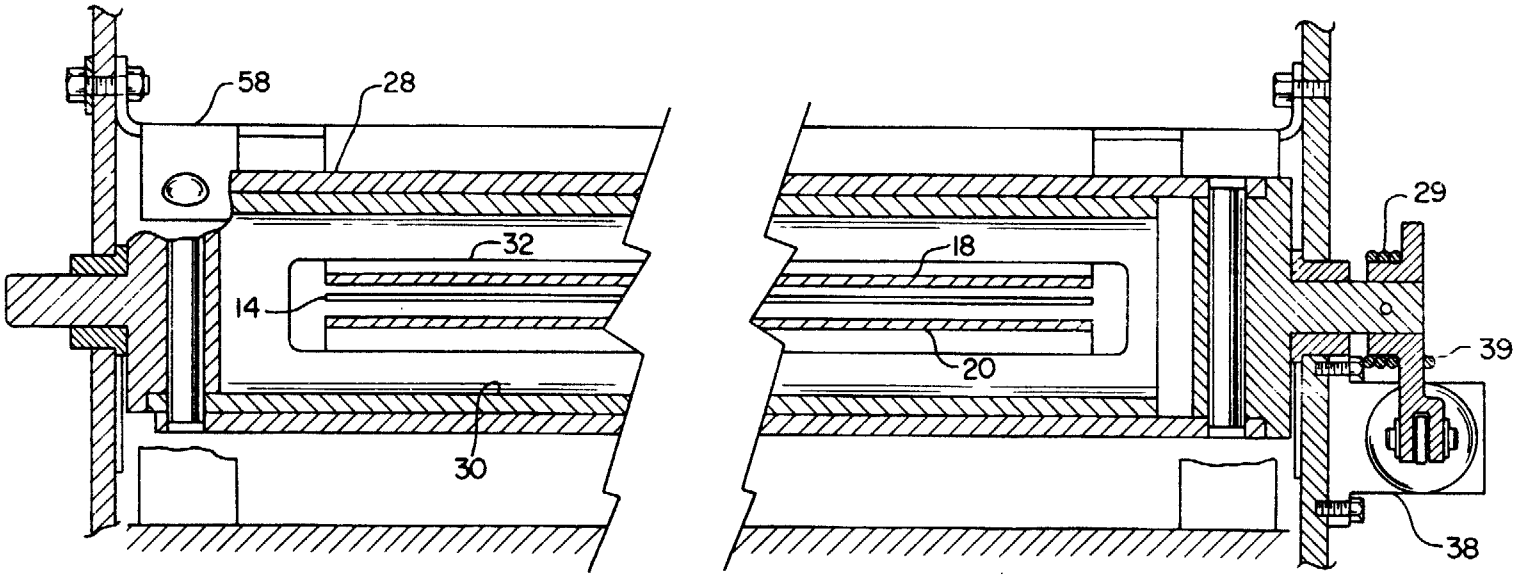
FIG. 4 is a sectional view taken on the vertical plane indicated by the line 4—4 in FIG. 1.

The tubular knife 16 includes rotatable outer tubular member 28 and a stationary concentric inner tubular member 30 contiguous with the outer tubular member 28. When the knife 16 is not actuated for cutting purposes, the outer tubular member 28 is biased by a torsion spring 29 (see FIGS. 4 and 5) to the position shown in FIG. 1 designated the home position. The inner tubular member 30 has a rear (relative to the direction of movement of the paper web 14) slot 32 while the outer tubular member 28 has a rear slot 34 which is larger in both circumferential directions than the slot 32 of the inner tubular member 30. It is only necessary, however, that the bottom edge 36 of the outer slot 34 extend sufficiently circumferentially below the paper web 14 so that when the outer tubular member 28 is actuated by a solenoid 38 to rotate clockwise in order to cut the paper web 14 the bottom edge 36 does not come in contact with the paper web 14.

Figure 5:
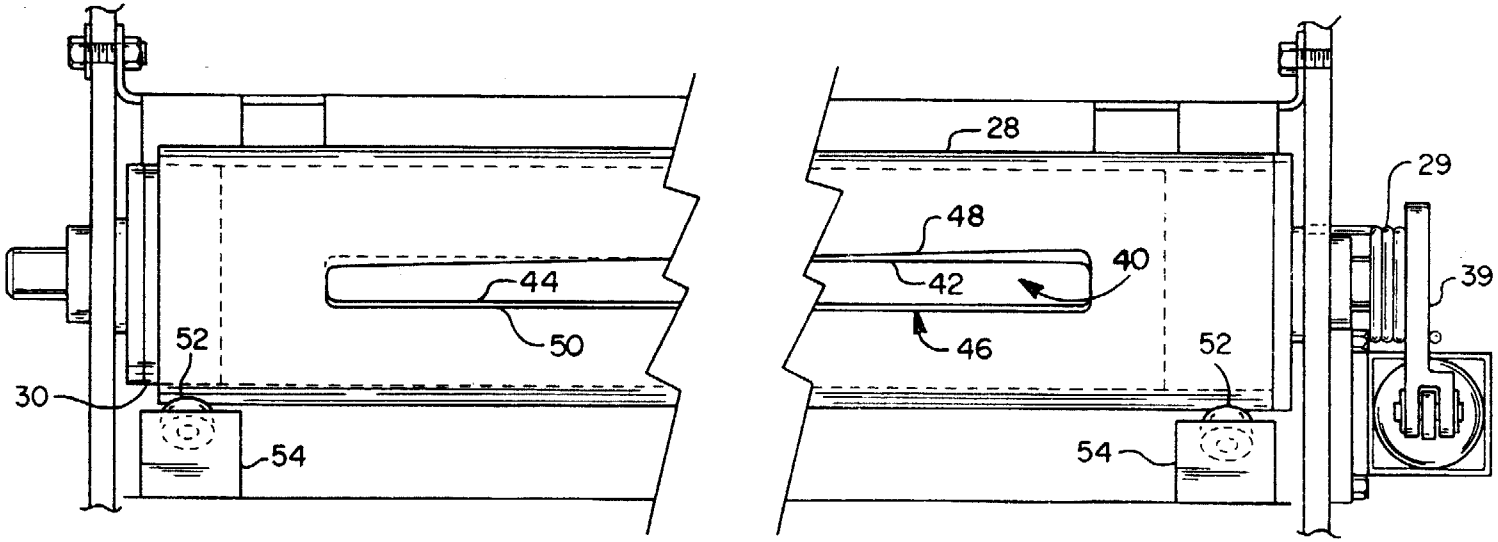
FIG. 5 is a sectional view taken on the vertical plane indicated by the line 5—5 in FIG. 1.

As best seen in FIG. 5, the inner tubular member 30 has a forward (relative to the direction of the movement of the paper web 14) slot 40 having a horizontal upper edge 42 and a horizontal lower edge 44, while the outer tubular member 28 has a forward slot 46 having an inclined upper edge 48 and a horizontal lower edge 50. In order that appropriate pressure is brought to bear between the outer and inner tubular members 28 and 30 in the cutting region, a pair of hemispheres 52 (only one is shown) are formed on a front loading spring 54 while a second pair of hemispheres 56 are formed on a rear loading spring 58. As seen in FIG. 1, when the outer tubular member 28 is biased to the home position, all four slots 32, 34, 40 and 46 are aligned to permit paper to pass therethrough.

Figure 3:
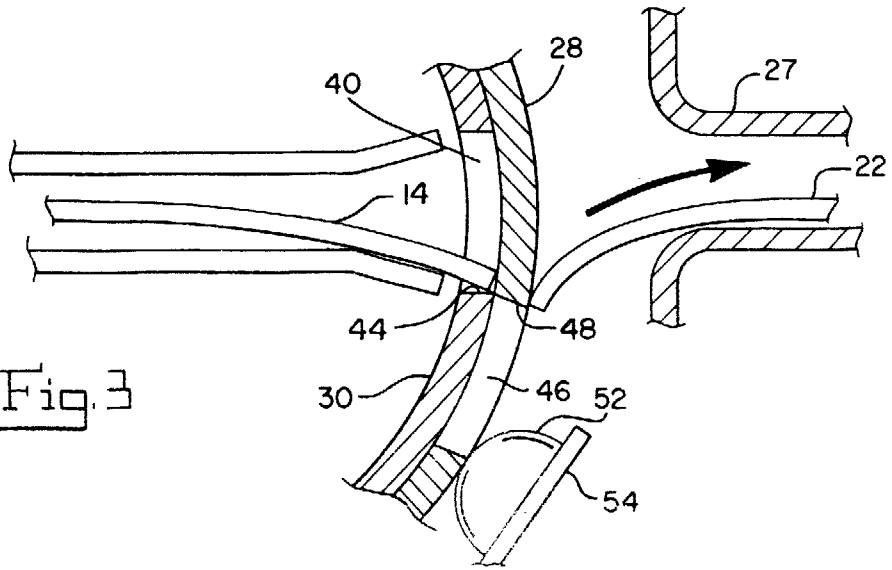
FIG. 3 is an enlarged view of the paper cutting area shown in FIG. 2.

To understand the cutting action, reference is made to FIG. 3, wherein the paper web 14 is seen at the instant it is severed. The inclined upper edge 48 of the outer slot 46 rotated past the horizontal lower edge 44 of the inner slot 40, so that a scissor action is effected upon the paper web 14 as it exits from the knife 16. The rotation of the outer tubular member 28 is effected by the solenoid 38 through an actuating arm 39. The scissor action comes about by virtue of the upper edge 48 being inclined. The severed portion 22 of the paper web 14 is then removed through the paper guides 27 and 29 by the feed rollers 24 and 26. Once the cutting action of the outer tubular member 28 is completed, the coil spring 29 returns the outer tubular member 28 to its home position preparatory to another cutting cycle.

It has been found that in order for the outer tubular member 28 to possess sufficient rigidity, it should be at least 1/16 inch thick when formed from stainless steel. Of course other metals may be used, and depending on their rigidity, other thicknesses may be required. The foregoing also applies to the inner tubular member 30. However, it should be understood that the inner tubular member 30 can have almost any thickness, and could even appear in cross section as two half circles. If the inner tubular member 30 assumes the two half circles configuration, then it is possible to eliminate the paper guides going through the tubular knife assembly 16.

Although the outer tubular member 28 is shown to constitute a full circle in cross section, it is only necessary that its cross section exceed 180° by an amount sufficient to assure that the outer tubular member 28 can rotate snugly about the inner tubular member 30. Cross sections of 240° for the outer tubular member 28 are adequate. Accordingly, tube or tubular member is hereby defined and understood to include cross sections less than 360°.

Although the preferred embodiment described hereinabove effects a cutting action by means of rotating the outer tubular member 28, it is also possible to employ a rotatable, inner cylindrical member with a fixed, outer tubular member. Furthermore, regardless of which of the inner and outer members is rotated, it is possible to cut the web of paper or other sheet material either as it enters the knife or as it exits from the knife, depending upon the nature of the material to be cut. Preferably, as seen in FIG. 3, the material would be cut as it exits from the knife. It is also obvious that the direction of rotation of the rotatable member and the various upper and lower cutting edges of the various slots may be reversed, thereby effecting cutting in an opposite direction, i.e. from low to high instead of from high to low as seen in FIG. 3. However, all these opposite cutting actions are virtually equivalent to each other.

Figure 7:
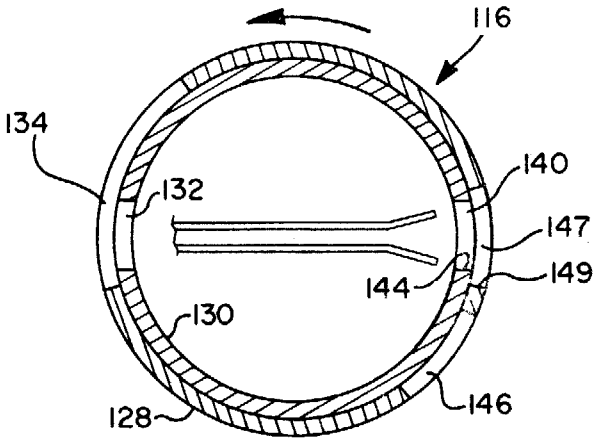
FIG. 7 is similar to FIG. 6 except that the outer tubular member of the knife is shown rotated to a second position.
Figure 6:
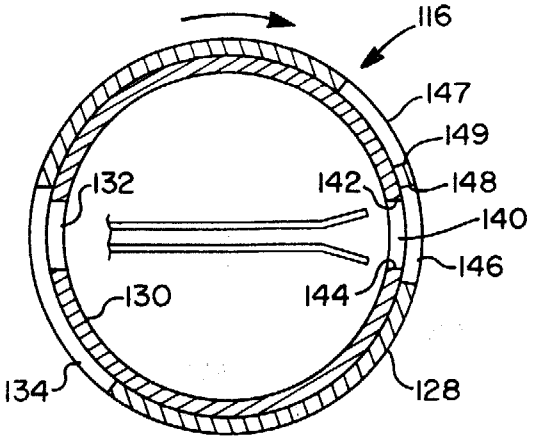
FIG. 6 is a radial sectional view of an alternative embodiment of a tubular knife according to the instant invention.

The preferred embodiment described above shows one forward slot 46 on the outer tubular member 28. However, if two forward slots are employed, substantially parallel to each other, properly spaced and angled, the cutting life of the entire mechanism can be doubled since the reciprocating motion of the outer tubular member 28 makes it possible to cut paper on the upward stroke as well as the downward stroke of the outer tubular member. With two forward slots on the outer tubular member, the upper as well as the lower edge of the inner tubular member would be used for cutting. Accordingly, the alternative embodiment seen in FIG. 6 showns a tubular knife 116 having a rotatable outer tubular member 128 and a stationary concentric inner tubular member 130 contiguous with the outer tubular member 128. The inner tubular member 130 has a rear slot 132 and a forward slot 140. The upper edge 142 and the lower edge 144 of the forward slot 140 are both horizontal and both function as cutting edges as explained hereinafter. The outer tubular member 128 includes an extended rear slot 134, a first forward slot 146 and a second forward slot 147. The upper edge 148 of the first forward slot 146 and the lower edge 149 of the second forward slot 147 are both inclined. Accordingly, when the outer tubular member 128 is rotated by conventional means clockwise from the home position of FIG. 6 to the home position of FIG. 7, a scissor action is effected between the inclined upper edge 148 and the horizontal lower edge 144. Similarly, when the outer tubular member 128 is rotated by conventional means counter-clockwise from the home position of FIG. 7 to the home position of FIG. 6, a scissor action is effected between the inclined lower edge 149 and the horizontal upper edge 142.

While the invention has been described with reference to the structures disclosed herein, it is not confined to the details set forth and this application is intended to cover such modifications or changes as may come within the purpose of the improvements or the scope of the following claims.

What is claimed is:

1. A tubular knife for cutting sheet material, comprising:

a stationary, inner cylindrical member having a forward slot extending substantially longitudinally thereof, said slot having a longitudinally extending upper cutting edge and a longitudinally extending lower cutting edge;

a rotatable, outer tube concentric and substantially contiguous with said inner member, said outer tube having a first forward slot and a second forward slot above said first forward slot, said first forward slot having a upper cutting edge inclined at a slight angle with respect to the lower cutting edge of the inner member, and said second forward slot having a lower cutting edge inclined at a slight angle with respect to the upper cutting edge of the inner member, each of said first and second forward slots being substantially co-extensive with said forward slot of said inner member; and means for rotating the upper cutting edge of the first forward slot past the lower cutting edge of the forward slot of the inner cylindrical member to a first home position and for rotating the lower cutting edge of the second forward slot past the upper cutting edge of the forward slot of the inner cylindrical member to a second home position.

2. The knife of claim 1, wherein the inner cylindrical member also includes a rear slot diametrically opposed to the forward slot therein, and wherein the outer rotatable tube also includes a rear slot diametrically opposed to the two forward slots therein.

3. The knife of claim 2, wherein the rear slot of the outer rotatable tube extends circumferentially a distance sufficient to avoid contact with the sheet material to be cut when the outer tube is rotated.

* * * * *